US009078547B2

(12) United States Patent
Cheng et al.

(10) Patent No.: US 9,078,547 B2
(45) Date of Patent: Jul. 14, 2015

(54) CLEANING DEVICE

(75) Inventors: Liang Cheng, Shanghai (CN); Gianmauro Vella, Shanghai (CN); Feng Zeng, Shanghai (CN)

(73) Assignee: 3M Innovative Properties Company, St. Paul, MN (US)

( * ) Notice: Subject to any disclaimer, the term of this patent is extended or adjusted under 35 U.S.C. 154(b) by 162 days.

(21) Appl. No.: 13/821,866

(22) PCT Filed: Sep. 27, 2011

(86) PCT No.: PCT/US2011/053445

§ 371 (c)(1),
(2), (4) Date: Mar. 8, 2013

(87) PCT Pub. No.: WO2012/047646

PCT Pub. Date: Apr. 12, 2012

(65) Prior Publication Data

US 2013/0174364 A1 Jul. 11, 2013

(30) Foreign Application Priority Data

Sep. 28, 2010 (CN) ..... 2010 2 0552262 U

(51) Int. Cl.

| | |
|---|---|
| ***A47L 13/12*** | (2006.01) |
| ***A47L 1/06*** | (2006.01) |
| ***A47L 1/16*** | (2006.01) |
| ***B25G 1/06*** | (2006.01) |
| ***B25G 3/10*** | (2006.01) |
| *A47L 13/44* | (2006.01) |

(52) U.S. Cl.

CPC ... *A47L 1/06* (2013.01); *A47L 1/16* (2013.01); *B25G 1/06* (2013.01); *B25G 3/10* (2013.01); *A47L 13/12* (2013.01); *A47L 13/44* (2013.01)

(58) Field of Classification Search

CPC ..... A47L 13/12; A47L 13/44; B25G 1/04
USPC ..... 15/220.1, 144.1, 144.3, 144.4, 105, 15/114, 115, 117, 118, 121
See application file for complete search history.

(56) References Cited

U.S. PATENT DOCUMENTS

| | | | | | |
|---|---|---|---|---|---|
| 834,667 | A | * | 10/1906 | Flynn | 15/121 |
| 2,446,401 | A | * | 8/1948 | Ziskind | 15/121 |
| 3,769,651 | A | | 11/1973 | Sunskes | |
| 5,007,753 | A | | 4/1991 | England, Jr. | |
| 5,083,338 | A | | 1/1992 | Unger | |
| 5,271,682 | A | | 12/1993 | Realdon | |

(Continued)

FOREIGN PATENT DOCUMENTS

| | | |
|---|---|---|
| CN | 200730121402.8 | 5/2008 |
| CN | 2012-08232 | 3/2009 |
| CN | 200830175985.7 | 8/2009 |

(Continued)

OTHER PUBLICATIONS

International Search Report for PCT International Application No. PCT/US2011/053445, Mailed on Apr. 23, 2012, 3 pages.

*Primary Examiner* — Laura C Guidotti

(57) ABSTRACT

Disclosed is a cleaning device that comprises a first arm portion with an adjustable length, a first cleaning portion, a second arm portion supporting the first cleaning portion, and a rotating adjustable portion located between the first arm portion and the second arm portion, the first arm portion being rotatable in a predefined range about the second arm portion.

5 Claims, 6 Drawing Sheets

(56) References Cited

U.S. PATENT DOCUMENTS

| | | | | |
|---|---|---|---|---|
| 5,823,592 | A * | 10/1998 | Kalidindi | 294/24 |
| 7,055,204 | B2 * | 6/2006 | Ajluni | 15/121 |
| 7,674,060 | B2 | 3/2010 | Lucero | |
| 2006/0288508 | A1 * | 12/2006 | Knopow et al. | 15/144.1 |
| 2007/0212157 | A1 * | 9/2007 | Hoadley et al. | 401/136 |
| 2011/0056035 | A1 * | 3/2011 | Burbacki | 15/144.1 |

FOREIGN PATENT DOCUMENTS

| | | |
|---|---|---|
| EP | 1872701 | 6/2009 |
| JP | 2000-254056 | 9/2000 |
| JP | 2006-263022 | 10/2006 |

* cited by examiner

CLEANING DEVICE

CROSS REFERENCE TO RELATED APPLICATIONS

This application is a national stage filing under 35 U.S.C. 371 of PCT/US2011/053445, filed Sep. 27, 2011, which claims priority to Chinese Patent Application No. 201020552262.6, filed Sep. 28, 2010, the disclosures of which are incorporated by reference in their entirety herein.

TECHNICAL FIELD

The present disclosed cleaning device comprises a first arm portion pivotally separated from a second arm portion, which supports a first cleaning portion.

BACKGROUND

Cleaning window panes is laborious and time-consuming work, especially on high rise buildings, where washing glass is not only difficult but also dangerous, thus it requires the service of specialized personnel.

A number of cleaning devices are provided in the prior art, such as the window cleaning device disclosed in U.S. Pat. No. 3,769,651, which comprises a U-shaped holder with a handle attached to one end and a cleaning head used for the cleaning of external windows attached to the other. The cleaning device disclosed in U.S. Pat. No. 3,769,651 is incapable of effectively cleaning upper story windows, however. U.S. Pat. No. 5,007,753 discloses a window cleaning apparatus that has a cleaning head that is rotatable to any position when used on a window surface; however, the angle of the handle is not adjustable. As a result, the apparatus is not adapted to clean of exterior windows.

SUMMARY

To overcome existing problems in prior art, the present disclosure provides a cleaning device, the cleaning device being adapted for the cleaning external windows and also the cleaning of external windows at different elevations. Moreover, the cleaning portion of the cleaning device achieves full contact with the glass surface, improving cleaning efficiency.

In one embodiment, the cleaning device comprises: a first arm portion having an adjustable length; a first cleaning portion; a second arm portion supporting the first cleaning portion; a rotating adjustable portion located between the first arm portion and the second arm portion wherein the first arm portion is rotatable in a predefined range about the second arm portion.

In one embodiment, the cleaning device further comprises: a second cleaning portion, said second cleaning portion being configured to mount detachably on the second arm portion. In one embodiment, the second arm portion is made from a flexible material. In one embodiment, the second arm portion takes the form of a "V" shape, and the second cleaning portion is mounted between the arms of the V-shaped second arm portion. In one embodiment, the rotating adjustable portion has a button, and pressing said button causes the first arm portion to rotate about the second arm portion. In one embodiment, hooks are disposed along the surface of the second cleaning portion, wherein the hooks are used for attachment of a cleaning cloth. In one embodiment, the second cleaning portion can be used independently, or may be used in combination with the first cleaning portion. In one embodiment, the predefined range is 0-180°. In one embodiment, the cleaning device further comprises a bottle containing a foam cleaning agent is attached to said first arm portion.

Figure 1:
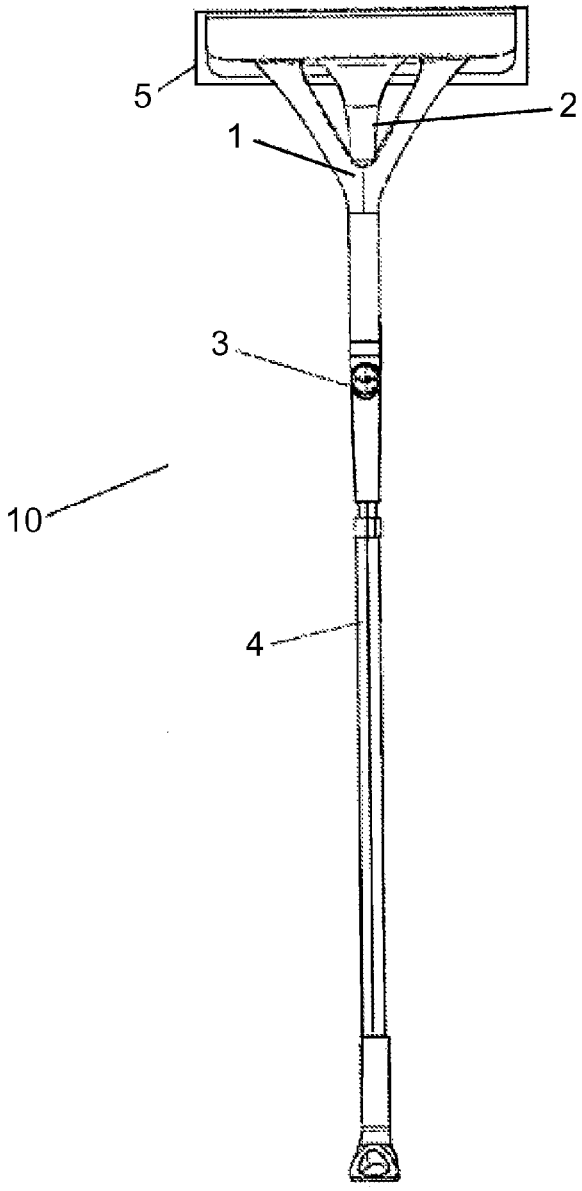
FIG. 1 is a front schematic view of on embodiment of a cleaning device.
Figure 2:
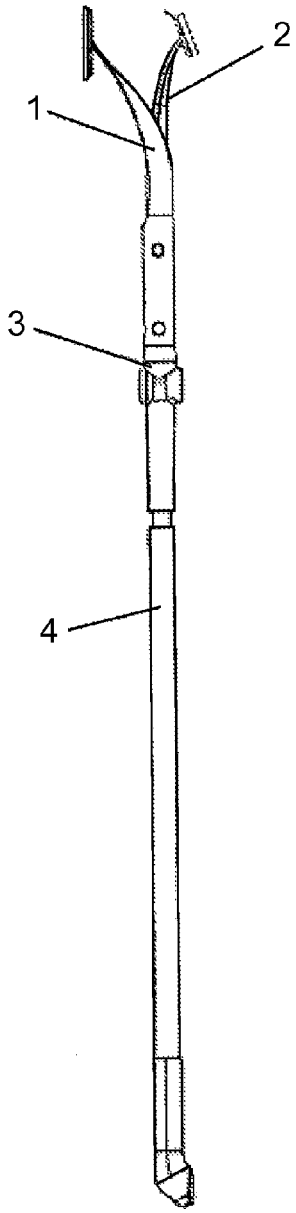
FIG. 2 is a lateral schematic view of the cleaning device of FIG. 1.

While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention. The figures may not be drawn to scale.

DETAILED DESCRIPTION

The cleaning device 10 of the present disclosure comprises: a first arm portion 4, the first arm portion 4 having an adjustable length; a first cleaning portion 5, the first cleaning portion 5 being adapted for the cleaning of glass surfaces; a second arm portion 1, said second arm portion 1 providing support to the first cleaning portion 5; a rotating adjustable portion 3, the rotating adjustable portion 3 being located between the first arm portion 4 and the second arm portion 1, the first arm portion 4 being rotatable in a predefined range about the second arm portion 1 by means of the rotating adjustable portion 3. In one embodiment, the predefined range is 0-180°.

The cleaning material mounted on the first cleaning portion 5 can be used for cleaning and also the absorption of liquid. During cleaning operations, the cleaning material can be detached when it becomes dirty, cleaned and then reattached to the first cleaning portion 5.

Figure 3:
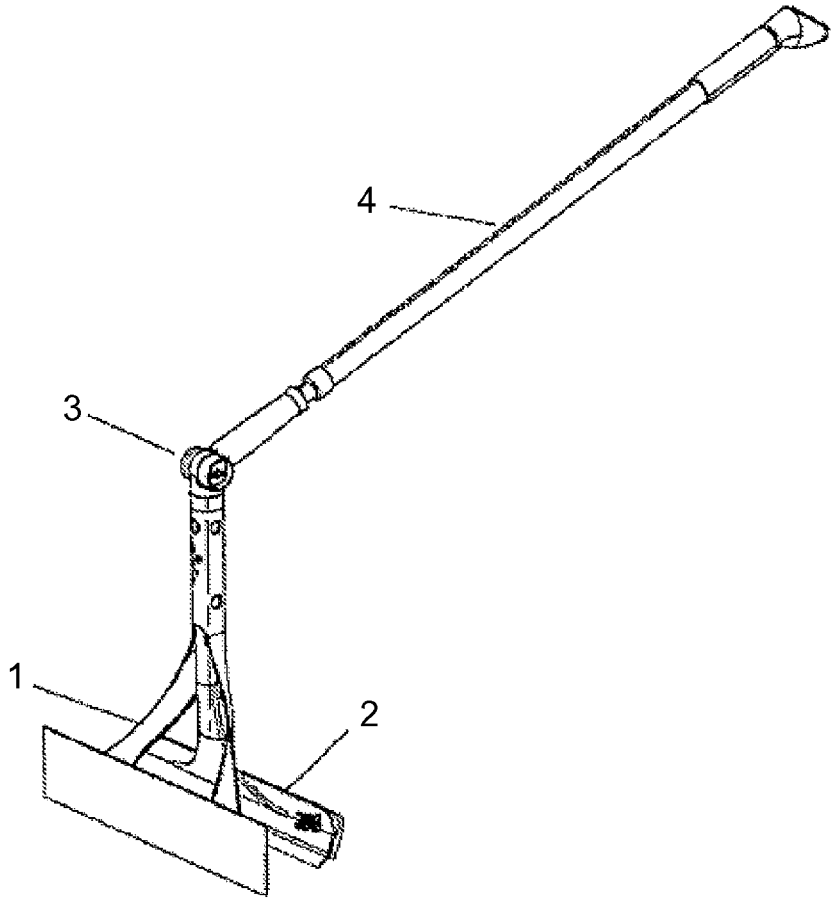
FIG. 3 is a schematic view of the predefined angle of first arm portion rotation.

As shown in FIG. 3, the first arm portion 4 rotates about the second arm portion 1 to a predefined angle. The cleaning device can therefore be extended outside the building to clean the glass of external windows. In addition, the extendable rod of the first arm portion 4 can be used to adjust the length of the first arm portion and thereby clean the glass of external windows at different elevations.

As shown in FIG. 1, the second arm portion may take the form of a "V" shape and be made from a flexible material, the flexible material being a rubber, thermoplastic elastomer or other resilient material. During cleaning operations, the flexibility of the second arm portion 1 enables full contact between the first cleaning portion 5 and the glass surface, reducing labour and improving the efficiency of cleaning operations.

Figure 4:
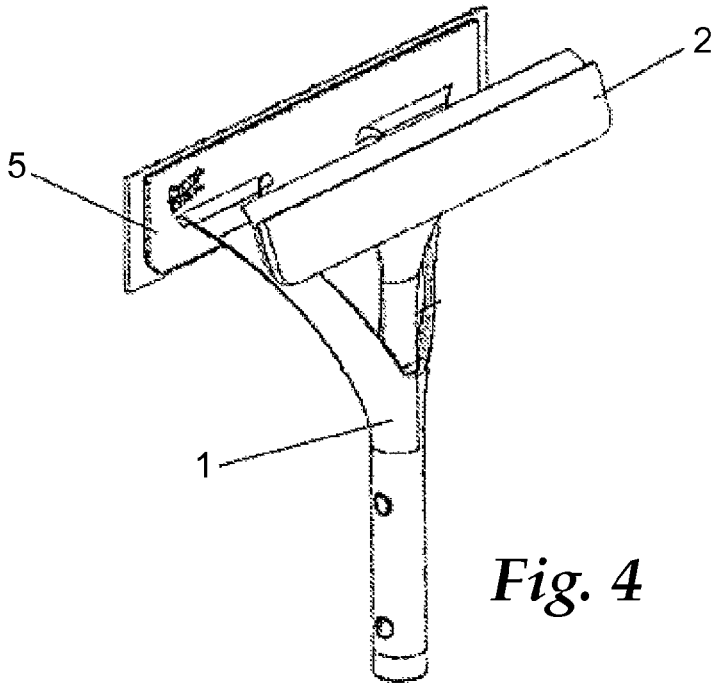
FIG. 4 is an enlarged partial view of the first cleaning portion and second cleaning portion.
Figure 5:
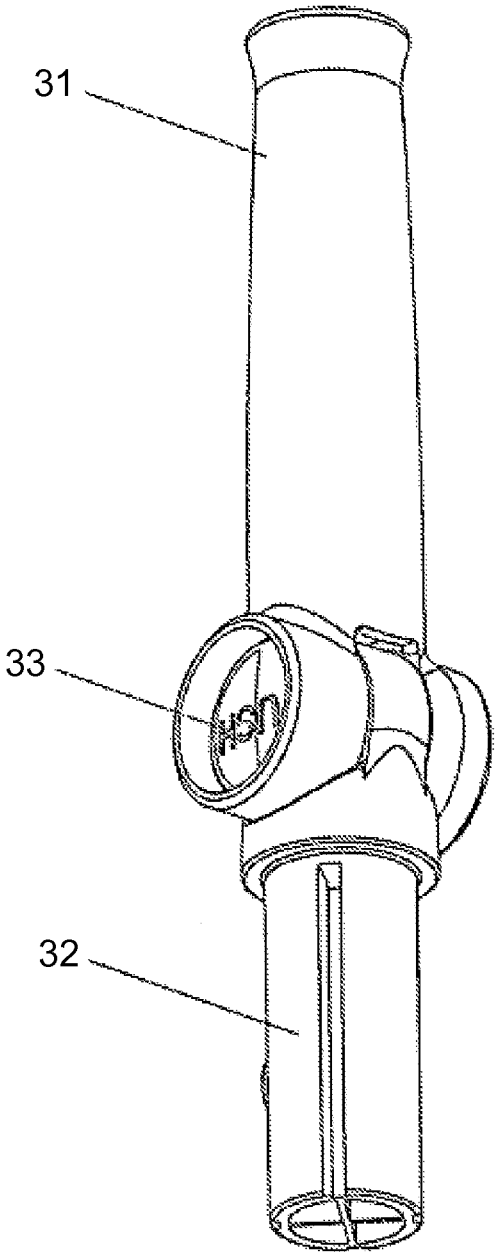
FIG. 5 is a schematic view of the rotating adjustable portion.

In one embodiment, the cleaning device further comprises a second cleaning portion 2, which is detachably mounted on the second arm portion 1. In the present embodiment, the second cleaning portion 2 is inserted between the arms of the second arm portion, as shown in FIG. 4. The second cleaning portion 2 can be used in combination with the first cleaning portion 5 or may also be used independently. Hooks may be disposed along the surface of the second cleaning portion 2 for attaching a cleaning cloth. The cleaning cloth is typically a non-woven fabric or other cleaning cloth, the scraping action of which is used to remove dirt.

As shown in FIG. 3, the rotating adjustable portion 3 has a button, and pressing said button causes the first arm portion 4 to rotate about the second arm portion 1 in a predefined range.

In one embodiment, the cleaning device further comprises a bottle containing a foam cleaning agent attached to the first arm portion 4.

Figure 7:
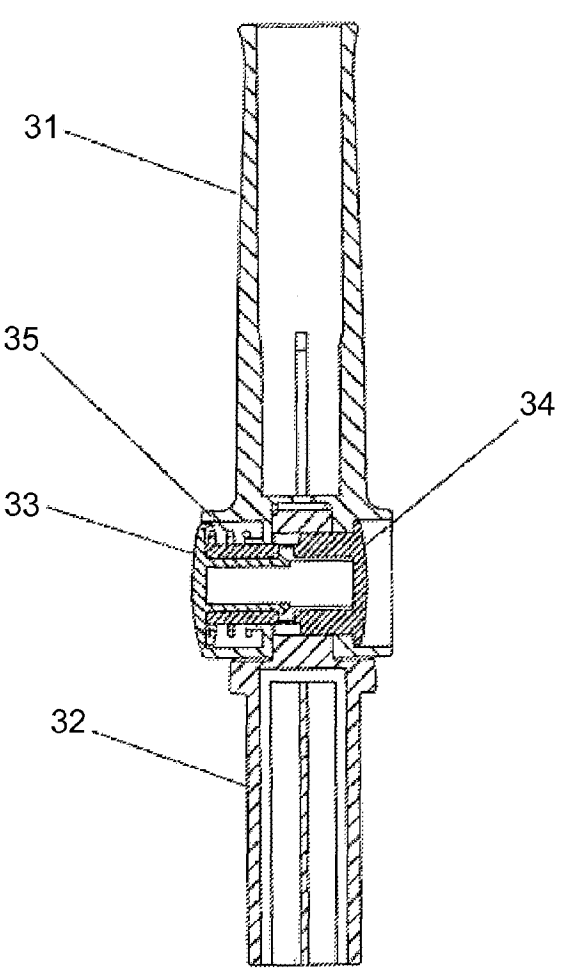
FIG. 7 is a cross-sectional view of the rotating adjustable portion.
Figure 6:
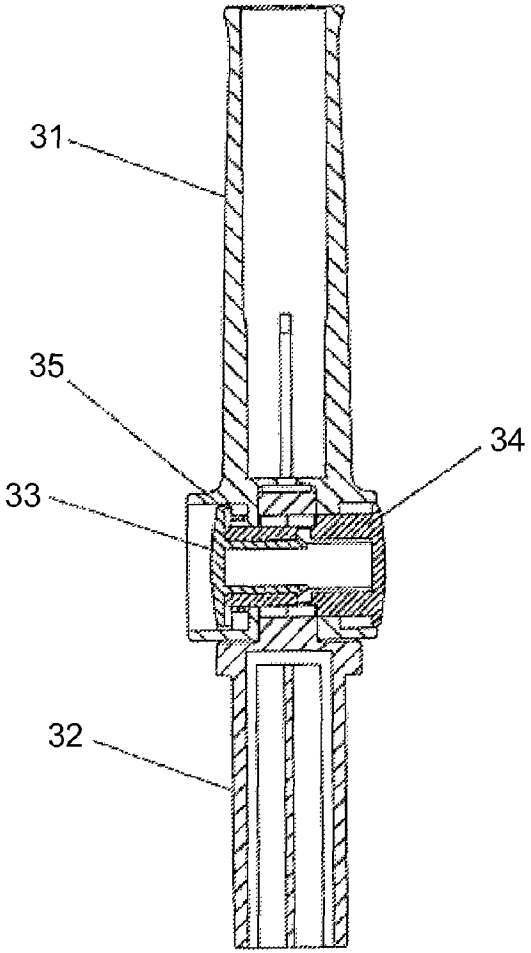
FIG. 6 is a cross-sectional view of the rotating adjustable portion.
Figure 8:
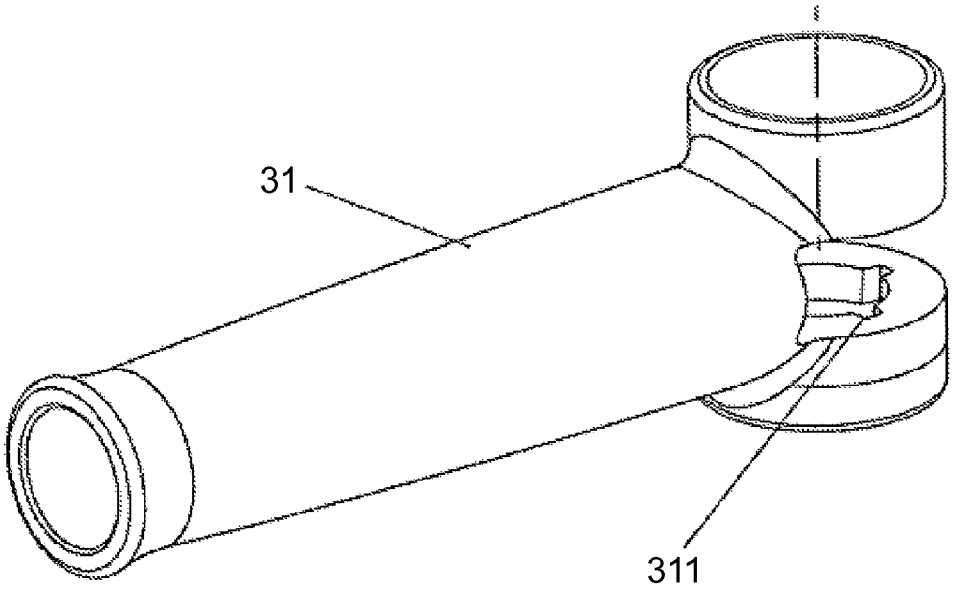
FIGS. 8-11 are schematic views of components of the rotating adjustable portion.
Figure 9:
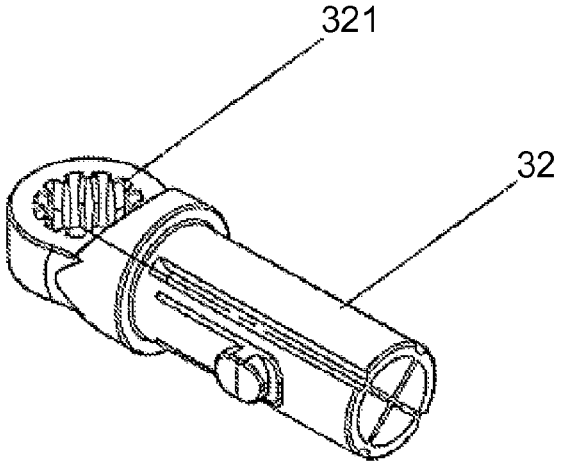
Figure 10:
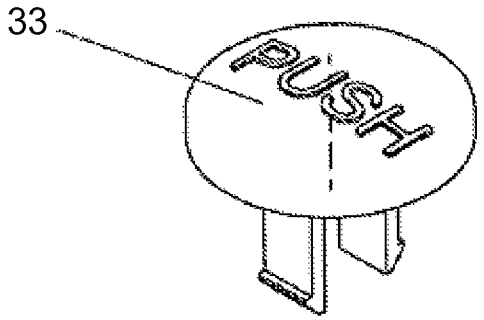
Figure 11:
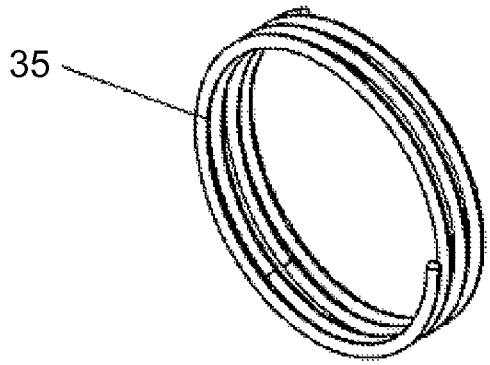

The rotating adjustable portion 3 shown is comprised of the following components: a first arm connecting portion 31, a second arm connecting portion 32, a button 33, a locking piece 34 and a spring 35, as shown in FIGS. 5-11. The button 33 and locking piece 34 are fixed together, and connect the first arm connecting portion 31 to the second arm connecting portion 32. Referring to FIGS. 6-7 and 11, in the absence of any external force, the elastic force of the spring 35 acts to insert the projecting portion 341 of the locking piece 34 into the recessed portion 321 of the second arm connecting portion 32 and the recessed portion 311 of the first arm connecting portion 31, locking the second arm connecting portion 32 and the first arm connecting portion 31 in place and preventing rotation; pressing the button 33 causes the projecting portion 341 of the locking piece 34 to slide outward, releasing the lock between the second arm connecting portion 32 and the first arm connecting portion 31, leaving them free to rotate. Consecutive and corresponding recessed portions are disposed in the interiors of the second arm connecting portion 32 and the first arm connecting portion 31, such that the second arm connecting portion 32 and the first arm connecting portion 31 can be locked at 30° intervals in a 0-180° range. An alternative number of recessed portions may also be disposed. Moreover, to ensure the strength of the locking connection, 4 projecting portions may be disposed symmetrically on the locking piece.

Method of use for the cleaning device: transfer the foam cleaning agent onto the second cleaning portion 2, use the second cleaning portion 2 to perform cleaning operations on the glass surface, then rotate the device 180° and use the first cleaning portion to remove the water and debris. When cleaning external windows, adjust the rotating adjustable portion, rotating the first arm portion about the second arm portion to a predefined angle, adjust the length of the first arm portion according to the position of the external window, then extend the cleaning device outside the building to clean the external window.

While particular embodiments of the present invention have been illustrated and described, a person of ordinary skill in the art will realize that these embodiments can be modified without departing from the principles and spirit of the present utility model, the scope of this invention being defined by the claims herein and their equivalents.

What is claimed:

1. A cleaning device comprising:

a first arm portion having an adjustable length;

a first cleaning portion;

a second arm portion supporting the first cleaning portion;

a second cleaning portion connected to the second arm portion, wherein the second arm portion takes the form of a "V" shape, and the second cleaning portion being detachably mounted between the arms of the V-shaped second arm portion; and a rotating adjustable portion located between the first arm portion and the second arm portion that allows for the first arm portion to rotate in a predefined range about the second arm portion.

2. The cleaning device of claim 1, wherein the second arm portion is made from a flexible material.

3. The cleaning device of claim 1, wherein the rotating adjustable portion has a button, and pressing said button causes the first arm portion to rotate about the second arm portion.

4. The cleaning device of claim 1, wherein hooks are disposed along the surface of the second cleaning portion, said hooks being used for attachment of a cleaning cloth.

5. The cleaning device of claim 1, wherein said predefined range is 0-180°.

* * * * *